US005615751A

United States Patent [19]

Snow

[11] Patent Number: 5,615,751

[45] Date of Patent: Apr. 1, 1997

[54] SCAFFOLD SYSTEM USED WITH WOOD PANELS

[76] Inventor: Richard J. Snow, 8500 E. Warren Ave., Denver, Colo. 80231

[21] Appl. No.: 387,225

[22] Filed: Feb. 13, 1995

[51] Int. Cl.[6] ..... E04G 3/10

[52] U.S. Cl. ..... 182/82; 182/150

[58] Field of Search ..... 182/82, 150; 211/119, 211/106; 248/215

[56] References Cited

U.S. PATENT DOCUMENTS

| | | | |
|---|---|---|---|
| 1,619,434 | 3/1927 | Reese | 211/119 X |
| 1,631,848 | 6/1927 | Yager | 182/150 X |
| 4,022,293 | 5/1977 | Hallagin | 182/150 |
| 5,398,824 | 3/1995 | Wolff | 211/106 X |

FOREIGN PATENT DOCUMENTS

| | | | |
|---|---|---|---|
| 4114328 | 11/1992 | Germany | 182/82 |

*Primary Examiner*—Alvin C. Chin-Shue
*Attorney, Agent, or Firm*—Edwin H. Crabtree; Ramon L. Pizarro; Donald W. Margolis

[57] ABSTRACT

An economic scaffold system used with wood and metal panels in the pouring of concrete foundations and the like. The system is designed to meet a recent 6 foot wall height restrictions federally mandated by OSHA. The system includes a pair of one piece panel brackets and a pair of one piece extension brackets make of heavy metal rod. The panel brackets are used alone with 8 foot high panels and with the extension brackets when using 10 foot high panels. The panel brackets are used to suspend opposite ends of a wood plank next to a side of a panel. The wood plank is used for workman to stand on during the forming of a foundation and when pouring concrete. The panel brackets include a pair of vertical support arms with an upper portion of the arms bent into an upper hook portion. The upper hook portion is received on top of the wood panel. A lower portion of the arms is bent into a "J" shaped plank support member. The plank support member is used to receive a portion of the plank thereon. The extension brackets also include a pair of vertical support arms with an upper portion of the arms bent into an upper hook portion. The upper hook portion is received on top of the panel. A lower portion of the arms is bent into a loop. The upper hook portion of the panel brackets is used for receipt over the loop of the extension brackets when the panel brackets are suspended therefrom.

10 Claims, 1 Drawing Sheet

SCAFFOLD SYSTEM USED WITH WOOD PANELS

BACKGROUND OF THE INVENTION (a) Field of the Invention

This invention relates to scaffolds and more particularly, but not by way of limitation, to a scaffold system used with wood forms in the pouring of concrete foundations and the like.

(b) Discussion of Prior Art

Heretofore there have been a variety of different types of scaffolds and scaffold systems for building construction. For example, U.S. Pat. No. 4,475,626 to Gleich describes a scaffold bracket having a hook for receipt around a portion of a window opening and a loop with cross brace for holding one end of a wood plank. U.S. Pat. No. 4,022,293 to Hallagin describes a fold-away hook platform. The platform in this patent includes upper hook portions for receipt on top of a door, gate, etc and a lower end portion having loops for receiving opposite ends of a wood plank. In Italian Patent 549,650 to Chichester a scaffold system is described using a plurality of vertical supports next to each other for support stepping grates. Also, U.S. Pat. No. 3,515,244 to Weible, U.S. Pat. No. 3,510,097 to McCaleb and U.S. Pat. No. 4,453,619 to Bierman describe different types of telescoping metal scaffold for attaching to the side of a building wall.

While some of the above mentioned patents have some of the individual features of the subject invention, none of them incorporate the unique combination of structure and function of the subject scaffold system as described herein.

SUMMARY OF THE INVENTION

In view of the foregoing, it is a primary object of the present invention to provide an economic low cost scaffold system for complying with a recent 6 foot wall height restriction federally mandated by OSHA. The scaffold system is used with 8 and 10 foot high wood and metal panels used in pouring concrete foundations and the like. Also, the system can be easily adapted to panels of different heights and shapes and applications other than concrete foundation work.

Another object of the invention is to provide a scaffold system that is made of heavy metal rod strong enough to support a wood plank and workman thereon. The system includes panel brackets and extension brackets that are easy to assembly and quickly attached to wood and metal panels when pouring concrete and then quickly disassembled when the job is completed.

Yet another object of the invention is the brackets are rugged in construction and formed into a one piece construction for rigidity. The brackets are adapted for receiving opposite ends of a 2 inch by 8 inch wood plank or can be used with other sizes of wood planks that are available on a job site.

Still another object of the scaffold system is to suspend a wood plank not higher than 6 feet from the ground surface for workman to safely stand on. The scaffold system eliminates the need for workman walking on or straddling concrete forms and using ladders when pouring concrete between the panels.

The subject invention includes a pair of one piece panel brackets and a pair of one piece extension brackets make of heavy metal rod. The panel brackets are used alone with 8 foot high panels and with the extension brackets when using 10 foot high panels. The panel brackets are used to suspend opposite ends of a wood plank next to a side of a panel. The wood plank is used for workman to stand on during the forming of a foundation and when pouring concrete. The panel brackets include a pair of vertical support arms with an upper portion of the arms bent into an upper hook portion. The upper hook portion is received on top of the panel. A lower portion of the arms is bent into a "J" shaped plank support member. The plank support member is used to receive a portion of the plank thereon. The extension brackets also include a pair of vertical support arms with an upper portion of the arms bent into an upper hook portion. The upper hook portion is received on top of the panel. A lower portion of the arms is bent into a loop. The upper hook portion of the panel brackets is used for receipt over the loop of the extension brackets when the panel brackets are suspended therefrom.

These and other objects of the present invention will become apparent to those familiar with different types of scaffolds used in the construction trade from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
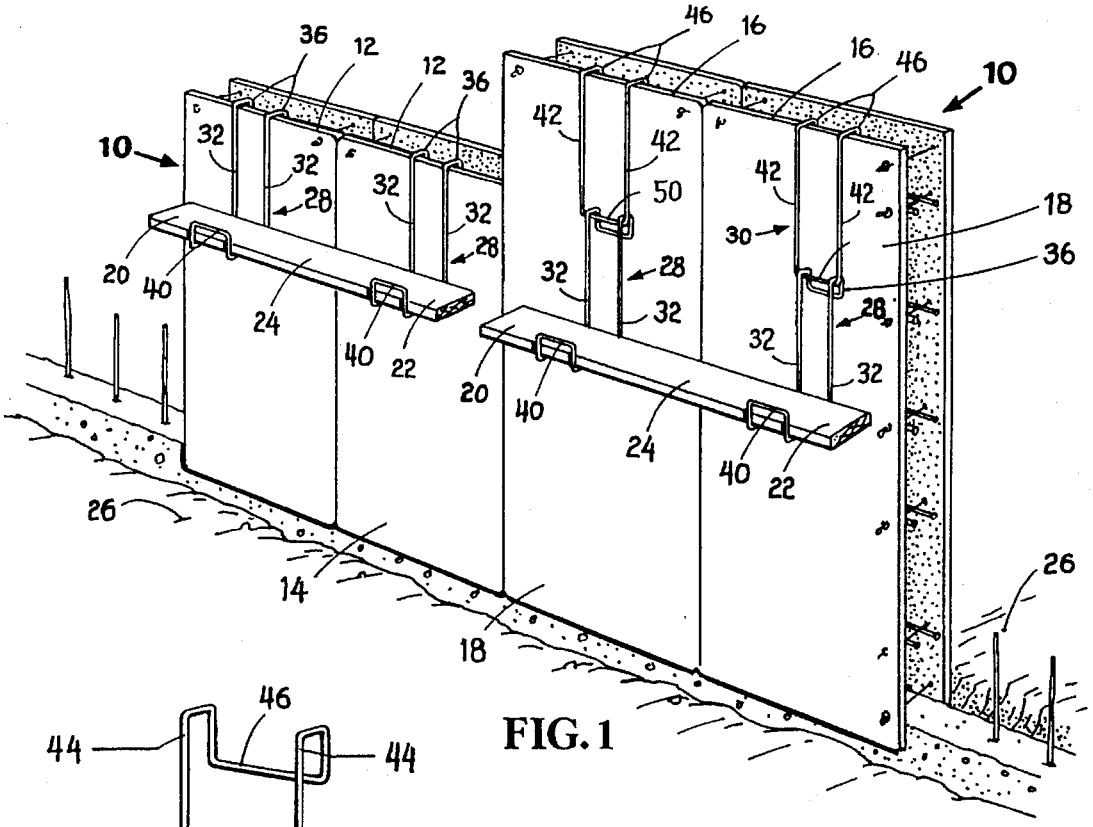
FIG. 1 is a perspective view of the subject scaffold system suspended from both a 8 foot panel and a 10 foot panel and holding wood plank adjacent sides of the panels.

FIG. 1 is a perspective view of the subject scaffold system having general reference numeral 10. The scaffold system 10 is shown suspended from both a top 12 of an 8 foot wood or metal panel 14 and a top 16 of a 10 foot wood or metal panel 18 for holding a first end 20 and a second end 22 of wood planks 24 thereon. The wood planks 24 are suspended by the system 10 adjacent the sides of the panels 12 and 14.

The system 10 is designed to meet recent 6 foot wall height restrictions federally mandated by OSHA. By this, any workman standing on the wood planks 24 and using the subject invention must not be any higher than 6 feet from a ground surface 26. Therefore, from the top of the ground surface 26 to the top of the wood planks 24, the distance must be 6 feet or less. The workman standing on the wood planks 24 when assembling the foundation, working on the concrete forms, securing the reinforcing bar and pouring concrete.

The system 10 includes a pair of one piece panel brackets having general reference numeral 28 and a pair of one piece extension brackets having general reference numeral 30. The panel brackets 28 and extension brackets 30 are formed into a one piece construction and are make of heavy metal rod. The metal rod may be hot rolled round or square bars having an ASTM A-36 rating and having a diameter in a range of ½ to ¾ inches. The mechanical properties of an ASTM A-36 rating being 58–80,000 psi tensile strength and 36,000 psi yield point. The panel brackets 28 are used alone with 8 foot high panels and with the extension brackets 30 when using 10 foot high panels. Also, the panel brackets 28 and extension brackets 30 may be made in various lengths with the typical length in a range of 24 inches.

While the panel bracket 28 and extension bracket 30 are shown in a form of "one piece" construction made of heavy metal rod with the ends of the rod welded together, it can be appreciated that the panel bracket 28 and extension bracket 30 may be made in similar designs, shapes and construction for engaging the top of concrete panels 14 and 18 and holding opposite ends of wood planks 24 without departing from the scope and spirit of the invention.

Figure 2:
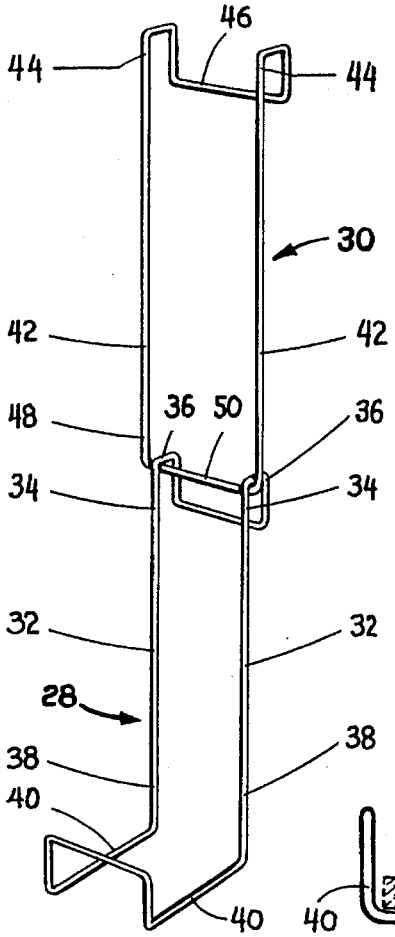
FIG. 2 is a perspective view of a panel bracket suspended from an extension bracket.
Figure 3:
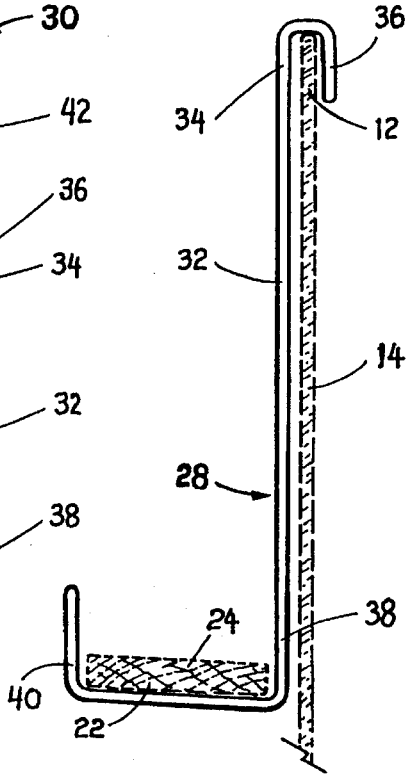
FIG. 3 is a side view of a panel bracket suspended from a portion of a panel.

Referring now to both FIGS. 1, 2 and 3, the panel brackets 28 include a pair of vertical support arms 32 with an upper portion 34 of the arms 32 bent into an upper hook portion 36. Note in FIG. 2, the arms 32 in forming the upper hook portion 36 are bent rearward for a distance in a range of 1½ inches, then downward in a range of 2 inches and then bent 90 degrees toward each other before joining the ends of the bracket 28 together. The upper hook portion 36 is received over the top 12 of the panel 14 and is suspended therefrom. The upper hook portion 36 is designed to be received over and engage the top of different thicknesses of concrete panels.

A lower portion 38 of the arms 32 is bent into a "J" shaped plank support member 40. The plank support member 40 is used to receive a portion of the first end 20 or second end 22 of the plank 24 thereon. Note in FIG. 2, the arms 32 are bent forward for a distance in a range of 8 inches, then upward in a range of 4 inches and then bent 90 degrees toward each other before joining the ends of the bracket 28 together. The design of the plank support member 40 is to accommodate wood planks of different sizes and shapes. In the drawings as an example, a 2 by 8 inch wood plank is shown for workman to stand on.

Figure 4:
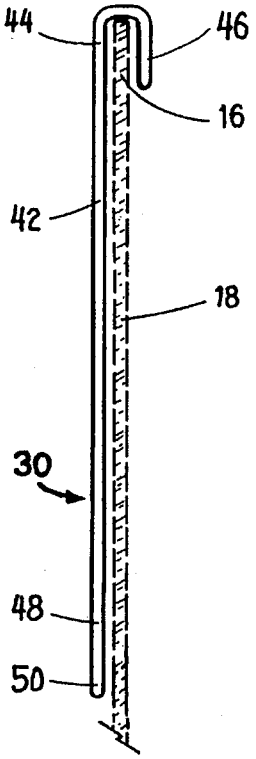
FIG. 4 is a side view of an extension bracket suspended from a portion of a panel.

Referring now to FIGS. 1, 2 and 4, the extension brackets 30 also include a pair of vertical support arms 42 with an upper portion 44 of the arms 42 bent into an upper hook portion 46. The upper hook portion 46 is received over the top 16 of the panel 18. Note in FIG. 2, the arms 42 in forming the upper hook portion 46 are bent rearward for a distance in a range of 1½ inches, then downward in a range of 2 inches and then bent 90 degrees toward each other before joining the ends of the bracket together.

A lower portion 48 of the arms 42 of the extension bracket 30 is bent into a loop 50. The loop 50 is used to receive the upper hook portion 36 of the panel brackets 28 thereon. The extension brackets 30, as mentioned above, are used together with the panel brackets 28 for extending the length of the scaffold system 10 when used with the 10 foot panels as shown in FIG. 1. Obviously if longer panels were used, more than one extension brackets 30 could be coupled together with the panel bracket 28 for increasing the length of the scaffold system 10 and meet the 6 foot wall height requirement.

FIG. 3 is a side view of a panel bracket 28 suspended from a portion of the top 12 of the 8 foot wood panel 14. In this illustration an end view of the wood plank 24 is shown received on top of the "J" shaped plank support member 40.

In FIG. 4 is a side view of an extension bracket 30 suspended from a portion of the top 16 of the 10 wood panel 18 is shown. The panel bracket 28 suspended on the loop 50 of the extension bracket 30 is not shown in this illustration. It should be mentioned that the width between the vertical support arms 42 of the extension brackets 30 may be in a range of 8 to 12 inches while the width between the vertical support arms 32 of the panel brackets 28 would be less so that the upper hook portion 36 can easily be received between the support arms 42 and engaged over the loop 50 as shown in FIGS. 1 and 2.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A scaffold system used with different size wood and metal panels in the pouring of concrete foundations and the like, the system used for holding a first end and a second end of a wood plank and suspending the wood plank adjacent a side of a panel, the wood plank used for workman to walk on, the system comprising:

a pair of one piece panel brackets, each of said panel brackets including a first vertical support arm with an end of an upper portion of the arm bent rearwardly for a certain distance, the end of the upper portion then bent downwardly for a certain distance and then bent 90 degrees;

said panel brackets including a second vertical support arm with an end of an upper portion of the arm bent rearwardly for a certain distance, the end of the upper portion then bent downwardly a certain distance and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent forward for a certain distance, then bent upward a certain distance and then bent 90 degrees; and the second vertical support arm with an end of a lower portion of the arm bent forward for a certain distance, then bent upward a certain distance and then bent 90 degrees with the end of the lower portion of the second vertical support arm joining the end of the lower portion of the first vertical support arm, the bending of the lower portion of the first and second vertical support arms forming a "J" shaped plank support member.

2. The scaffold system as described in claim 1 further including a pair of one piece extension brackets, each of said extension brackets including a first vertical support arm with an end of an upper portion of the arm bent rearwardly for a certain distance, the end of the upper portion then bent downwardly a certain distance and then bent 90 degrees;

said extension brackets including a second vertical support arm with an end of an upper portion of the arm bent rearwardly for a certain distance, the end of the upper portion then bent downwardly a certain distance and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent 90 degrees;

the second vertical support arm with an end of a lower portion of the arm bent 90 degrees with the end of the lower portion of the second vertical support arm joining the end of the lower portion of the first vertical support arm, the bending of the lower portion of the first and second vertical support arms forming a "loop"; and the upper "hook" portion of said panel brackets used for receipt over the "loop" of said extension brackets when said panel brackets are suspended therefrom.

3. The scaffold system as described in claim 1 wherein said panel brackets are formed using heavy metal rods.

4. The scaffold system as described in claim 2 wherein said extension brackets are formed using heavy metal rods.

5. A scaffold system used with different size wood and metal panels in the pouring of concrete foundations and the like, the system used for holding a first end and a second end of a wood plank and suspending the wood plank adjacent a side of a panel, the wood plank used for workman to walk on, the system comprising:

a pair of one piece panel brackets, each of said panel brackets including a first vertical support arm with an end of an upper portion of the arm bent rearwardly for a certain distance in a range of 1 to 2 inches, the end of the upper portion then bent downwardly for a certain distance in a range of 1 to 3 inches and then bent 90 degrees;

said panel brackets including a second vertical support arm with an end of an upper portion of the arm bent rearwardly for a certain distance in a range of 1 to 2 inches, the end of the upper portion then bent downwardly a certain distance in a range of 1 to 3 inches and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent forward for a certain distance in a range of 6 to 12 inches and then bent upward a certain distance in a range of 2 to 6 inches and then bent 90 degrees; and the second vertical support arm with an end of a lower portion of the arm bent forward for a certain distance in a range of 6 to 12 inches and then bent upward a certain distance in a range of 2 to 6 inches and then bent 90 degrees with the end of the lower portion of the second vertical support arm joining the end of the lower portion of the first vertical support arm, the bending of the lower portion of the first and second vertical support arms forming a "J" shaped plank support member.

6. The scaffold system as described in claim 5 further including a pair of one piece extension brackets, each of said extension brackets including a first vertical support arm with an end of an upper portion of the arm bent rearwardly for a certain distance in a range of 1 to 2 inches, the end of the upper portion then bent downwardly a certain distance in a range of 1 to 3 inches and then bent 90 degrees;

said extension brackets including a second vertical support arm with an end of an upper portion of the arm bent rearwardly for a certain distance in a range of 1 to 2 inches, the end of the upper portion then bent downwardly a certain distance in a range of 1 to 3 inches and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent 90 degrees;

the second vertical support arm with an end of a lower portion of the arm bent 90 degrees with the end of the lower portion of the second vertical support arm joining the end of the lower portion of the first vertical support arm, the bending of the lower portion of the first and second vertical support arms forming a "loop"; and the upper "hook" portion of said panel brackets used for receipt over the "loop" of said extension brackets when said panel brackets are suspended therefrom.

7. The scaffold system as described in claim 5 wherein said first and second panel brackets are formed using heavy metal rod having a diameter in a range of ½ to ¾ inches with the ends of the rod welded together to form the one piece construction.

8. The scaffold system as described in claim 6 wherein said first and second panel extension brackets are formed using heavy metal rod having a diameter in a range of ½ to ¾ inches with the ends of the rod welded together to form a one piece construction.

9. The scaffold system as described in claim 6 wherein said first and second panel brackets and said first and second panel extension brackets are formed using a metal rod of hot rolled round or square bars having an ASTMA-36 rating and having a diameter in a range of ½ to ¾ inches, the mechanical properties of an ASTM A-36 rating being 58–80,000 psi tensile strength and 36,000 psi yield point.

10. A scaffold system used with different size wood and metal panels in the pouring of concrete foundations and the like, the system used for holding a first end and a second end of a wood plank and suspending the wood plank adjacent a side of a panel, the wood plank used for workman to walk on, the system comprising:

a pair of one piece panel brackets, each of said panel brackets including a first vertical support arm with an end of an upper portion of the arm bent rearwardly for a certain distance, the end of the upper portion then bent downwardly for a certain distance and then bent 90 degrees;

said panel brackets including a second vertical support arm with an end of an upper portion of the arm bent rearwardly for a certain distance, the end of the upper portion then bent downwardly a certain distance and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent forward for a certain distance, then bent upward a certain distance and then bent 90 degrees; and the second vertical support arm with an end of a lower portion of the arm bent forward for a certain distance, then bent upward a certain distance and then bent 90 degrees with the end of the lower portion of the second vertical support arm joining the end of the lower portion of the first vertical support arm, the bending of the lower portion of the first and second vertical support arms forming a "J" shaped plank support member;

a pair of one piece extension brackets, each of said extension brackets including a first vertical support arm with an end of an upper portion of the arm bent rearwardly for a certain distance, the end of the upper portion then bent downwardly a certain distance and then bent 90 degrees;

said extension brackets including a second vertical support arm with an end of an upper portion of the arm bent rearwardly for a certain distance, the end of the upper portion then bent downwardly a certain distance and then bent 90 degrees with the end of the upper portion of the second vertical support arm joining the end of the upper portion of the first vertical support arm, the bending of the upper portion of the first and second vertical support arms forming an upper "hook" portion;

the first vertical support arm with an end of a lower portion of the arm bent 90 degrees;

the second vertical support arm with an end of a lower portion of the arm bent 90 degrees with the end of the lower portion of the second vertical support arm joining the end of the lower portion of the first vertical support arm, the bending of the lower portion of the first and second vertical support arms forming a "loop"; and the upper "hook" portion of said panel brackets releasably received over the "loop" of said extension brackets when said panel brackets are suspended from said extension brackets.

* * * * *